United States Patent [19]

Storchheim

[11] 4,244,738

[45] Jan. 13, 1981

[54] METHOD OF AND APPARATUS FOR HOT PRESSING PARTICULATES

[76] Inventor: Samuel Storchheim, 2201 S. Stewart, Lombard, Ill. 60148

[21] Appl. No.: 889,745

[22] Filed: Mar. 24, 1978

[51] Int. Cl.[2] ..... B22F 3/14; B22F 3/24

[52] U.S. Cl. ..... 75/211; 29/420.5; 75/226; 75/227; 148/126

[58] Field of Search ..... 75/226, 211, 227; 29/420.5; 148/126

[56] References Cited

U.S. PATENT DOCUMENTS

| | | | |
|---|---|---|---|
| 2,809,891 | 10/1957 | Ennor | 75/226 |
| 3,076,706 | 2/1963 | Daugherty | 75/226 X |
| 3,241,948 | 3/1966 | Claiborne et al. | 75/0.5 C |
| 3,331,686 | 7/1967 | Bonis et al. | 75/226 X |
| 3,386,821 | 6/1968 | Rice et al. | 75/226 |
| 3,407,062 | 10/1968 | Matthews et al. | 75/214 |
| 3,533,782 | 10/1970 | Claus et al. | 75/226 X |
| 3,605,245 | 9/1971 | Zapf | 29/420.5 |
| 3,720,512 | 3/1973 | Yamaguchi | 75/226 X |
| 3,744,118 | 7/1973 | Whalen | 29/420.5 X |
| 3,764,308 | 10/1973 | Horn et al. | 75/226 X |
| 3,772,009 | 11/1973 | Isaksson | 75/226 X |
| 3,778,249 | 12/1973 | Benjamin | 75/226 X |
| 3,787,205 | 1/1974 | Church | 75/226 |
| 3,795,129 | 3/1974 | Goto | 29/420.5 X |
| 3,864,809 | 2/1975 | Donachie | 29/420.5 |
| 3,901,661 | 8/1975 | Kondo et al. | 75/0.5 BA X |
| 3,953,205 | 4/1976 | Cox et al. | 75/226 X |
| 3,954,458 | 5/1976 | Roberts | 75/226 X |
| 3,992,763 | 11/1976 | Haynie | 29/420.5 |
| 4,069,042 | 1/1978 | Buchovecky et al. | 75/226 X |
| 4,101,348 | 7/1978 | Berchtold | 75/226 X |

OTHER PUBLICATIONS

Wick, C. H., *Mach. & Production Eng.,* 117: pp. 668–670, 10/21/70.

*Metal Progress,* 99 (4): pp. 54–60, Apr. 1971.

Huseby, R. A. et al., Paper Presented at Int. Powder Met. Conf., (p/m '70), N.Y. Jul. 16, 1970.

Brown, G. T. et al., *Int. J. Powder Met.* 6 (4): pp. 29–42, Oct. 1970.

*Primary Examiner*—Richard E. Schafer

[57] ABSTRACT

Articles are formed by hot pressing metal or metallic particulates at temperatures between about the recrystallization temperature and about the solidus temperature for the metal or alloy after first preheating the particulates and the die. The particulates are hot pressed for a very short period of time, usually less than five seconds at about 12 tons per square inch or greater to compact and weld the particles together into a wrought metal article having substantially greater tensile strength and a better isotropic strength than a conventional cast or powder metallurgy article of the same metal or alloy. Additionally, the articles can be made with 99+ percent of theoretical density and with substantially no gas porosity. The article's surfaces may be smooth and held to relatively close tolerances with a good uniformity of surface hardness. Articles can be formed using conventional die presses to press articles repetitively without welding of the articles to die walls even when using aluminum particulates. The preferred particulates are substantially larger in size than the conventional powder materials used in powder metallurgy and appear to be strain hardened during the hot pressing thereof.

22 Claims, 17 Drawing Figures

THICKNESS VARIATION VS HOT PRESS TEMP. (30 TSI)

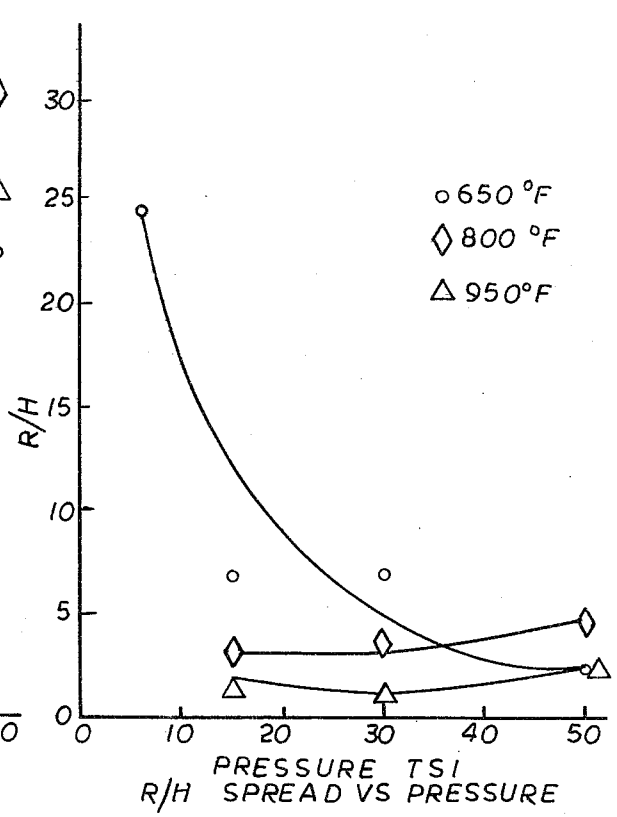
Fig. 3
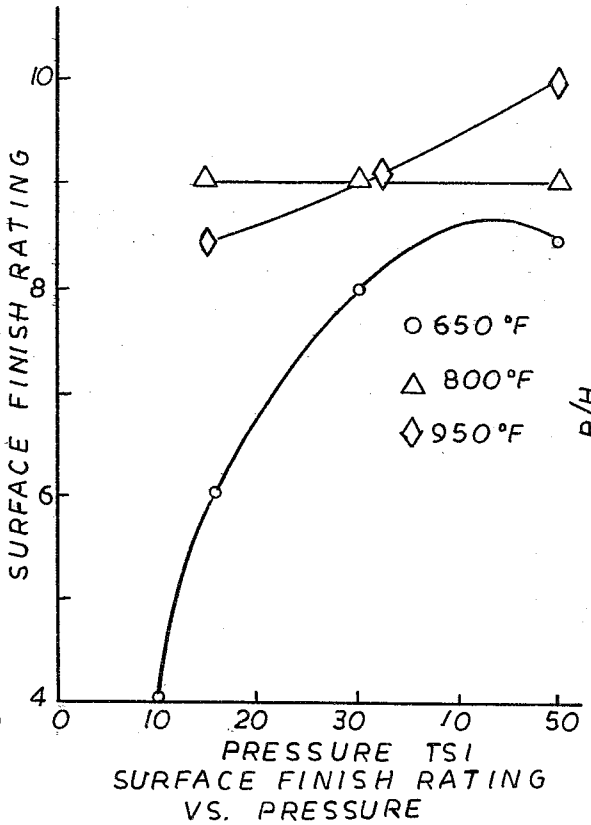
Fig. 4
Fig. 5

HOT PRESS TEMPERATURE OF
7075 SCHWARF HOT PRESSED HARDNESS
VS. HOT PRESSING TEMP. 50 TSI/2 SEC.

HOT PRESS TEMPERATURE
7075 MACHINED CHIPS UTS VS.
TEMPERATURE (50 TSI FOR 5 SEC.)

7075 DRILLINGS HOT PRESSED AT 900°F/50 TSI, LONGITUDINAL CROSS-SECTION, ETCHED AT 100X

TRANSVERSE SECTION OF ECAL AT 950°F/15 TSI. ETCHED 50 X

LONGITUDINAL SECTION OF ECAL AT 950° F/15 TSI. ETCHED 50 X

PHOTOMICROGRAPH OF MG-3, HOT PRESSED FROM PIECES OF MAGNESIUM RIBBON

EC AL GRAIN STRUCTURE INSIDE NEEDLE PARTICULATES. ETCHED 200 X

PHOTOMICROGRAPH OF NO. CU-6 HOT PRESSED FROM CU SHOT

PHOTOMICROGRAPH OF MG-5, HOT PRESSED FROM BITS OF MAGNESIUM ALLOY WIRE

METHOD OF AND APPARATUS FOR HOT PRESSING PARTICULATES

This invention relates to the formation of precision metal articles from metal or metallic particles and to a method of and apparatus for compacting and consolidating such particles at elevated pressures and temperatures.

From a commercially significant standpoint, the use of particulate metals to form articles has been limited principally to aluminum powder or other powder metallurgy materials and products therefrom. The present invention is directed to expanding the horizons for the use of particulate materials beyond the powder metallurgy technology and beyond the metals commonly used therein to encompass iron, lead, magnesium, copper, molybdenum, and other materials as well as aluminum. Also, with the present invention, hot pressed particulates are formed into articles with such superior properties that enable the use of such articles in applications heretofore not thought possible. As will be explained in greater detail, it is possible to manufacture directly by a hot pressing technique precision parts with sufficient strength, dimensional precision, and surface characteristics that the parts may be used directly or with a minimum of machining operations.

The most common and hence proper reference for the state of the art of forming articles from particulate metal is the art of aluminum powder metallurgy. Typically, the aluminum powder metallurgy process requires the use of pure aluminum metal powder which may be coated with a lubricant and cold pressed in a die to form a green product. Then the green product is sintered for 20 minutes in a protective atmosphere. The sintered product, somewhat distorted, is later repressed or coined in a press to the finished article. The aluminum powder metallurgy article made with such a process is generally brittle and has some porosity and lacks the high tensile strength of products machined from annealed and forged aluminum bars. Hence, the aluminum powder metallurgy process suffers from the limitations of requiring an expensive pure aluminum raw material, several time-consuming steps, and formation of a relatively weak and porous article.

On the other hand, the hot pressing method of the present invention allows the use of either pure metal aluminum or alloy aluminum materials and the use of aluminum alloy scrap commonly called "swarf". The use of scrap as a raw material provides a major reduction in the cost of raw materials for the product. With the hot pressing method of the present invention, aluminum or aluminum alloy particles may be hot pressed directly and quickly into a desired shape with precision dimensional surfaces in contrast to the cold pressing, sintering, and coining operations used for powdered aluminum metallurgy, as above described.

Additionally, it has been found possible to strain harden the particles as they are being hot pressed into precision dimensioned products to provide increased mechanical properties more akin to cast-wrought annealed products but without the expense of an annealing process. Higher tensile strengths in hot pressed articles of lightweight metals such as aluminum or magnesium should open new markets, such as for bearings, gears, connecting rods, etc. These precision molded products would not have to be machined significantly as is the case with cast and wrought aluminum articles. Heretofore, to obtain very high strength from cast aluminum bars, the bars were forged or extruded to provide wrought metal characteristics to the metal which was then later cut or otherwise formed into the geometrics with machining being required for close tolerance parts. The present invention provides compacted articles which have strengths and properties generally approaching those obtained by forging or extruding but with a much simpler and more direct hot pressing process with substantial economic savings over conventional wrought processing techniques as described above.

Some work has heretofore been done with hot pressing of aluminum particles into sheets, as disclosed in U.S. Pat. No. 3,076,706. The hot pressing method disclosed therein is substantially different in that different pressure and temperature relationships were used and further in that the sheet was formed between rolls having an opening pass at the ends thereof. More specifically, the sheet was formed between water-cooled rolls with the temperature of the rolls at the nip being about one-half the temperature to which the aluminum particles were preheated. Further, the calculated pressure was about 12,000 psi and the resulting sheet had a generally fibrous character. Typically, the sheet was reduced in thickness by cold rolling subsequent to formation and then annealed and crystallized at about 600° F. to obtain the desired physical characteristics for the sheet. In the present invention, however, the pressure are significantly higher, for example, 20,000 to 100,000 psi and the temperatures employed are higher and result in a nonfibrous product. Grain growth is avoided and the metal article has properties more akin to a wrought-annealed aluminum article than a cold-worked fibrous metal article as made in U.S. Pat. No. 3,076,706. Further, products made with the hot pressing technique of the pressing invention may give the appearance of being annealed although they have not been annealed.

It is possible to further strengthen the hot pressed articles of the present invention by additional hardening by means of quenching and aging, that is, age hardening heat treating, immediately after formation of the compacted article. That is, the hot pressed particles may be hot pressed at a temperature where an alloying agent may go into solid solution followed by a quenching operation and aging to provide a precipitation hardened article.

The present invention also has a preferred apparatus which has the capability of forming articles with relatively thick cross sections, e.g., ½ inch or greater, at elevated temperatures and pressures without the articles welding or otherwise sticking to the die. For a fast commercially acceptable process, the dies should be capable of being used repetitively. With the present invention, aluminum particles may be hot pressed in dies made of ordinary tool steel which can withstand the relatively low temperatures of 400° to 660° C. employed in the hot pressing process. The material sticking to the die problem is further alleviated by the use of die lubricants such as graphite or other materials. For the thicker cross section articles, the hot pressing process may employ a two-step or phase compaction in a single die with an initial compaction of the particles to remove substantially the main voids therebetween within a first portion of the die. For instance, an initial compaction of about 85% of the final density for the article followed by shifting the compacted material to another portion of the die also having a lubricated coating on the die walls for a final subsequent compacting to the final density for the article. Preferably, the apparatus will have an automatic die lubrication system. Further, it has been found that the large particles are preferably agitated or otherwise kept moving while they are being preheated so that they do not agglomerate and will freely mix and pour to fill the cavities in the hot pressing die. If desired, the heated aluminum particles may be kept in a protective atmosphere within a feed box for the die but the actual pressing may be done in an ambient atmosphere because of the relatively short pressing times used in the compacting operation.

Accordingly, the general object of the invention is to provide a new and improved hot pressed particulate article and to provide a method of and an apparatus for manufacturing such an article.

A more specific object of the invention is to provide a new and improved wrought article made from compacted particles of aluminum or aluminum alloys hot pressed at elevated temperatures and pressures to provide a strain hardened product.

A further object of the invention is to provide a method and apparatus which can mold precision products with good mechanical properties from low-cost particulate raw materials and in time periods of 30 seconds or less.

These and other objects of the invention will become apparent from the following detailed description taken in connection with the accompanying drawings in which:

FIG. 3 is a graph illustrating the effect of a change of temperature on the surface finish of hot pressed articles made in accordance with the invention.

FIG. 4 is a graph illustrating the effect of pressure on the surface finish of the articles made in accordance with the invention.

FIG. 5 is a graph illustrating the effect of pressure on a Rockwell Hardness differential between different portions of an article made in accordance with the invention.

Figure 1:
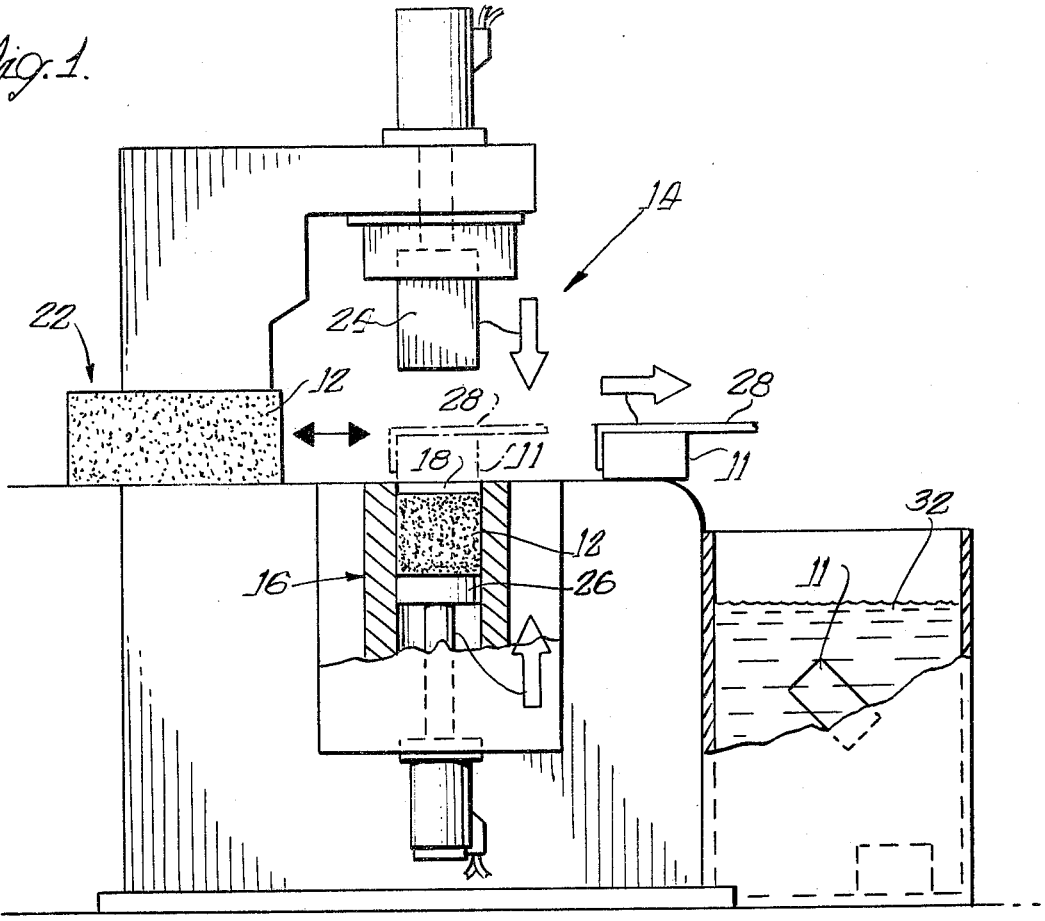
FIG. 1 is a diagrammatic view of an apparatus for practicing the method of hot pressing metal or metallic particles into articles in accordance with the present invention.
Figure 2:
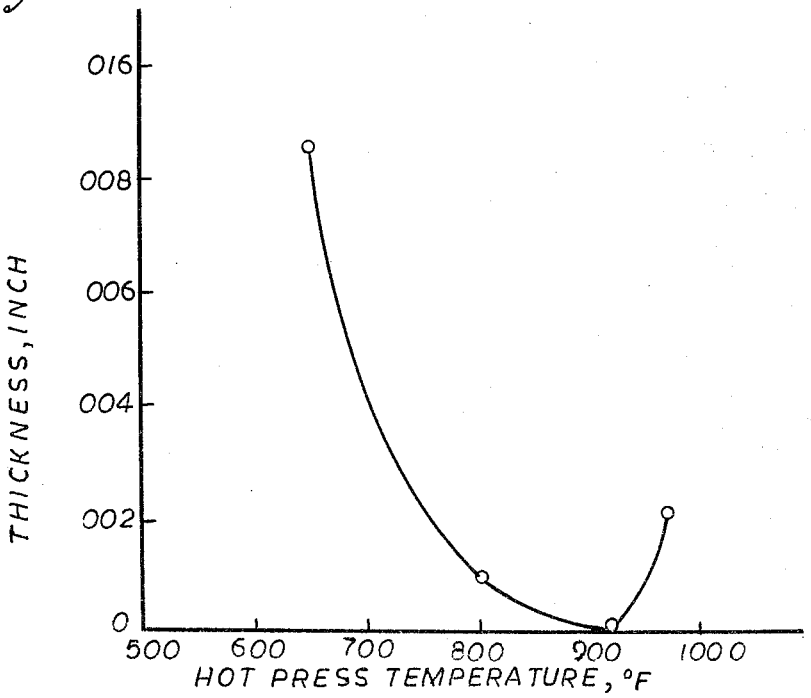
FIG. 2 is a graph illustrating the effect of temperature change on the thickness differential articles made with the invention.

As shown in the drawings for purposes of illustration, articles 11 may be formed by hot pressing heated particles 12 in a hot pressing apparatus having a heated die 14. The illustrated die comprises a heated die body 16 having an internal cavity 18 which is filled with preheated particulates from a heated feed means or box 22 in which are stored the preheated particulates. The die may take various shapes and forms but herein is illustrated as having an upper top punch 24 connected to a conventional press for downward movement into the die cavity to compress a charge of particulates at a desired pressure and for a given amount of time. To facilitate ejection of the article from the die, a bottom punch 26 is movable upwardly in the die cavity to eject the compacted article 11 from the die cavity. The ejected article may be shifted transversely from the die by a transfer means 28 which may shift the article into a quenching tank 32, if a quenching is desired.

In accordance with the present invention, articles 11 formed of hot pressed metal or metallic particulates may be made by a unique hot pressing process with strength and other properties superior to properties obtained from directly cast metals and with properties such as tensile strength greater than those of cast articles and approaching those of wrought articles formed by working the cast article. Moreover, the articles appear to have more isotropic tensile strengths than do cast articles of the same metal. The articles appear to be cold worked and annealed to provide a wrought article even though the articles have not been given a conventional annealing or heat treatment subsequent to the formation thereof. The particulates used in the preferred hot pressing process are relatively large as compared to powder particles and it is thought that these larger particulates afford sufficient volume of metal to be worked when being consolidated under elevated temperatures and pressures within a die. It appears although it is not certain that particles are strain hardened when deformed and compressed to eliminate the voids therebetween. The preferred articles are formed with high densities approaching substantially theoretical density and have been found to have substantially no gas porosity as contrasted to the high porosity aluminum powder metallurgy parts. Further, the exterior surfaces of the articles may be smoother and held to closer tolerances then exterior surfaces of cast articles.

In accordance with the present invention, articles 11 can be produced economically and repetitively from the die 14 when using current die presses to hot press articles 11 at relatively high speeds and with materials, such as aluminum or aluminum alloys, which are normally thought to weld themselves to dies or to preclude the formation of relatively thick cross-sectional articles. As will be explained in greater detail hereinafter, many aluminum articles 11 having wrought properties may be pressed with the punches 24 and 26 merely hitting the particulates with a fast high speed compression with little or no dwell time when performing the maximum compression. That is, the press speeds may be quite high and there is no need, in most instances, for any extended dwell before retracting the punches. Because low price scrap may be used as the raw material for the particulates and because of the speed of production, the method of forming such articles is of particular importance.

More specifically and in accordance with the present invention, the preferred method comprises the steps of: providing particulates 12 of metal or metallic alloy (preferably having a surface area to volume relationship in the range of 3 to 1,000) and being free flowing to fill the die cavity 18, preheating the particulates (as within the preheat box 22) to a temperature within the range of between about the recrystallization temperature for the metal or alloy and about the solidus temperature for the alloy (i.e., the melting point of the metal), heating the die cavity 18 to a temperature sufficient to maintain the particulates within said temperature range during a subsequent hot pressing, hot pressing the preheated particulates by the application of sufficient pressure (e.g., 20,000 to 100,000 psi) to consolidate the particulates into a high density article for a time period of less than 30 seconds while maintaining the particulates within said temperature range, removing the article 11 from the heated die cavity 18. The preferred process and articles formed therefrom are made with particulates in the form of particles larger in size than conventional powder particles because such larger size particles do not tend to sinter weld to each other when pre-heated and because it is though that the larger size particles are able to cold work and/or strain harden whereas the very fine powder particles may not. As used herein, the term "particulates" is generic to the preferred larger size particles having (SA/V) surface area to volume relationships in the range of about 3 to 1000 and to the powders, such as aluminum powders, which typically have SA/V relationships of 1500 or larger. Thus, as used herein, the term "particulates" is used in a generic sense to refer to both larger size particles and the smaller size powders and the term "particles" is used to indicate metal pieces having an SA/V relationship of about 3 to 100. Metal pieces with SA/V relationships substantially above 1000 will be termed "powders" hereinafter.

As used herein, the surface area to volume relationship is defined by dividing the surface area in square inches by the volume in cubic inches. The relationship will thus be expressed in terms of inches to the $10^{-1}$ power. Of course, a similar division may be performed for a metric area in square millimeters divided by a volume in cubic millimeters. In the preferred method, the products may be compressed with sufficient pressure to obtain a density of about 99% of theoretical density. Further, particles may be heated and hot pressed at about the solution annealing temperature for the metal or alloy and then subsequently age hardened to provide a further strengthening of the article.

It is an important aspect of the process that the particles are hot pressed while at a temperature above their recrystallization temperature and below their melting or solidus temperature for a short period of time (30 seconds or less) and then cooled below the recrystallization temperature before the grains in the particles can recrystallize and grow or anneal. For example, for aluminum alloy particles, the article may be hot pressed for less than 4 seconds at a temperature above the recrystallization temperature but below the solidus temperature and removed and cooled quickly below the recrystallization temperature so as to prevent substantial grain growth or any substantial annealing. Surprisingly, it has been found that the hot pressed article is hard rather than soft. If one allows the hot pressing temperature to go above "about the solidus temperature" or above the melting temperature to the extent that a significant portion of the particles attain a liquid state before or during hot pressing, the hardness and tensile strength will be significantly diminished. As used herein, the term "about the solidus temperature" is intended to include temperatures which may be as much as 10% or even 20% higher than the theoretical solidus temperature for a given alloy for the reason that at these temperatures slightly above the theoretical or exact "solidus temperature" for the alloy there is insufficient liquid from the particles present to substantially adversely affect the results. However, when a substantial amount of liquid from the particles is present, the drop-off in strength is dramatic and recognizable, as will be discussed in greater detail hereinafter. The hardness and tensile strength may be retained by quickly bringing the temperature of the article back down below the recrystallization temperature before grain growth or annealing occurs which will result in a softening of the article and some loss of tensile strength. On the other hand, the article may be subsequently heat treated if so desired or the article may be shifted while still very hot to a die or forging press for further working.

Additionally, articles made with generally uniformly shaped and sized particles and hot pressed in accordance with this invention may provide more uniform isotropic properties such as transverse and longitudinal tensile strength than is the case with cast or wrought articles of the same metal or alloy. By preheating and then hot pressing uniform particles such as needles or spheres of substantially uniform size, the particles deform and join to form a uniformly appearing matrix or a lamellar cross section which provides better isotropic qualities for the article than from a cast or a wrought article in which there is a marked temperature differential occurring during casting and cooling between the interior and outer portions of the article or a difference caused by continued unidirectional strain hardening, annealing and strain hardening for the wrought product. As will be seen from later examples, the longitudinal and transverse tensile strengths for hot pressed parts may differ as little as 5% from each other.

In contrast to usual porosity found in powder metallurgy articles, the articles 11 may be made with substantially zero porosity and full density, that is, a density equal to about 100% of the theoretical density. These high density articles are also found to be significantly more leak-proof to oil or gas than the more porous sintered powdered aluminum metallurgy articles or die cast aluminum articles. The microstructure of the article is similar to that of an article that is fully annealed even though no annealing has taken place. The surface characteristics of the articles are very good, being very uniform and highly reproducible as to hardness and dimensional tolerances.

In addition to enhanced strength properties over cast metal articles or powder metal articles, hot pressed articles made with the present invention may be significantly more commercially desirable by allowing the use of less expensive scrap raw materials than powder metallurgy processes which generally require a commercially pure grade metal or alloy. Scrap aluminum often has some alloying material therein preventing its reuse in powder metallurgy. Such materials are readily useable in the described process and provide desirable hot pressed articles. Also, from an economic standpoint, the hot pressing process of the present invention allows a quick, efficient one-step process to form wrought-like articles with good surface finishes and close tolerances so that the articles may be used as made, or with relatively little machining in contrast to cast articles. It has been found that the hot pressing process of the present invention is also particularly useful for making slugs or pieces having greater strengths than cast metal articles and which can be later forged into finished pieces with less scrap or material to be removed from the finished piece than when forging from conventional slugs of wrought metal. From a cost standpoint, the hot pressed slugs made with this invention may be cheaper than wrought bars which have been heat-treated and extruded before being forged.

In addition to the strength obtained from strain hardening of the particles during the hot pressing, hot pressed articles of appropriate alloys may be provided with additional strength by precipitation hardening. That is, the alloy particles may be heated to and compacted at their solution annealing temperature followed by quenching or otherwise cooling of the article quickly to below the recrystallization temperature followed by either natural precipitation hardening or suitable oven heat treatment aging to cause precipitation of the alloying agent. Thus, hot pressed alloy articles may be made which have been first strain hardened and then quenched and aged to provide additional hardening.

Referring now in greater detail to the preferred process, the initial step of the process is to provide particulates of a size which will not sinter weld during the preheating thereof and which will flow when very hot and to fill any die cavities which is not true of conventional powders such as aluminum powders having SA/V relationships of 1500 or greater. Generally speaking, at least for aluminum, the larger particle sizes provide significantly better tensile strength and harder products than do particle sizes approaching or exceeding a 1000 relationship. This is thought to result from a greater volume of metal to strain harden during the hot pressing process. One form of particle which has been successfully used is a needle-shaped aluminum particle formed by pouring molten aluminum into a perforated spinning cup and using centrifugal force to snap off particulate needles emerging from the apertures. A general description of one process for forming aluminum particles is disclosed in U.S. Pat. No. 3,241,948. The preferred particles are fairly uniform in size and have a minimum of oxidation. Aluminum needles having lengths ranging from 0.1 to 0.250 inch and a maximum diameter of about 0.015 inch have been used. Apparent densities for the aluminum needles range from about 1.3 gram/cc for the coarser needles to 1.1 gram/cc for the finer needles, the latter being close to the apparent density for conventional aluminum powder of 1.1 grams per cc.

The raw material used to form the aluminum needles may be scrap aluminum which will usually have some alloying metal therein. The scrap (commonly called "swarf") can be cleaned and degreased prior to being melted within a furnace and poured into the perforated rotating cup to be spun out as needles. By spinning at a constant speed and temperature, the aluminum particles obtained may be uniform in size and possess a high degree of luster with nearly 100% utilization of the molten aluminum being poured into the cup. Aluminum particles of about ¼" in length have been used successfully.

Other much larger aluminum particles, such as 3/16" cubes, also have been hot pressed in accordance with the method described herein. It is considered that spherical particles may be even more advantageous because of their lower surface area to volume relationship and their good packing and filling characteristics within the die. The uniformity of particles as to both size and shape is preferred to obtain more isotropic qualities for the hot pressed article.

Rather than melting the scrap and reforming the same into acicularly or spherically shaped particles, scrap machine shop drillings or cuttings may be broken up in a hammer mill to the desired size and then hot pressed in the die. That is, the swarf, if small enough in size, may be used directly for the hot pressing process.

As disclosed above, the particles are preheated to about their hot pressing temperature prior to being inserted into the die cavity 18. Some cooling of the particles may occur during transfer into the die. Preferably, the particles are preheated within a means such as a feed box 22 by resistance heaters (not shown) and an inert hot gas flows through the feed box to prevent substantial oxidation of the particles while in residence in the feed box. Also, the particles may be agitated while in the feed box by shaking them with a vibrating means (not shown) to prevent their sticking to one another while in the feed box. Preferably, the particles will be at or slightly warmer than the temperature at which the subsequent hot pressing occurs to account for any temperature loss during transfer from the feed box into the heated die 14.

The very short periods of time to compact the particles and to remove the article from the die and to cool the same below the recrystallization temperature is a key factor not only to the properties obtained for the article itself but also is a key factor in the economics of producing parts cheaper than heretofore. In contrast, the typical time period for sintering powder compacts in powder metallurgy is 20 minutes or more and later heat treating operations require hours or fractions of hours. The ability to form parts in a hot press and to remove them within 4 or 5 seconds with the parts having superior strength characteristics makes the present invention most attractive from an economic standpoint.

Additionally, a one-step process to form an article is superior to the typical multiple steps used to form articles by other conventional processes. For example, an aluminum powder metallurgy product requires a first molding of a green product followed by a later sintering operation which may take up to an hour. The sintered intermediate product is then usually pressed or coined in a press to provide the finished powder metallurgy product. Manifestly, the multiple handling and the various time periods employed make the powder metallurgy product more expensive. Further, aluminum powder metallurgy normally is practiced at a higher temperature than temperatures used in the specific examples given hereinafter when pressing aluminum or aluminum alloy particles. Additionally, the sintering, which removes the internal lubricant in the green compact, causes an air-pollution problem and generally results, even after coining, in a product which is not entirely free of porosity. Aluminum powder metallurgy parts are generally unsatisfactory for applications requiring leak proof capabilities for hydraulics.

As previously stated, the time period for hot pressing is preferably so short that there is no annealing during compaction and so short that there is no substantial grain growth as during recrystallization. In the preferred method, the articles are quickly removed from the heated die 14 either by ejecting the same automatically by one of the rams or by using a split die body which can be readily opened to facilitate removal of the article for cooling below the recrystallization temperature before any significant recrystallization occurs.

When the particles are alloyed metal particles and are preheated to a high temperature but below the solidus of the alloy and are held in this preheated condition for a period of time to allow solution annealing to take place, the articles formed by a subsequent hot pressing followed by a quenching operation may be strain hardened and additionally strengthened by a precipitation hardening.

The quenching in water or other liquid will obtain a supersaturated solution and then the article may be allowed to naturally age at room temperature. For example, aluminum alloy particles may be hot pressed quickly and then immediately ejected and quenched. The hot pressed aluminum article may then be allowed to naturally age for four days at room temperature to provide a T-4 heat treated aluminum article. The aluminum article may, if desired, be further heat treated to T-6 condition by placing the article in a temperature of about 250° F. for a period of about 18 hours. For most metals, the number and kinds of alloying agents used for precipitation hardening are well known. Although only aluminum has been mentioned specifically as being hardened by precipitation, it is to be understood that other alloyed metals, such as magnesium or steel, be precipitation hardened.

Consideration now will be given in greater detail to the various parameters of temperature, pressure and time for one specific example, namely, aluminum alloys, and other parameters for other metals may be obtained and ascertained. For pure metal aluminum particles, the temperature will not exceed the melting temperature of 660° C. at which some melting of aluminum will occur. Likewise, the temperature will be above the recrystallization temperature for aluminum. For aluminum alloys, the temperature of recrystallization and the solidus temperature will vary with the amount of alloying material. Generally speaking, the temperatures used in the process will be from about a recrystallization temperature of about 400° C. for aluminum alloys to the solidus curve temperature of about 600° C. The solution annealing temperature will be closer to the solidus curve than the recrystallization temperature for aluminum alloys.

Better mechanical properties are obtained when hot pressing aluminum alloy particles at higher temperatures closer to the solidus temperature because the particles will be more plastic and will consolidate and fill any crevices or fine details in the mold, as will be explained for aluminum alloys being hot pressed at temperatures of about 800° F. to 900° F., in connection with the graphs of FIGS. 2 to 10, than when hot pressing at lower temperatures, such as 600° to 800° F. That is, it appears that the particles are more plastic and flow and weld easier when at the higher temperatures than at lower temperatures near the recrystallization temperature. However, it will be recognized that a temperature of about 900° F. is still below the solidus temperature and that there is a marked fall-off of properties if the particles are hot pressed at temperatures above the solidus and at which a significant amount of the particles have become molten.

It should also be emphasized that from a cost standpoint, the ability to hot press the aluminum particles at temperatures of 900° F. or lower for a time period of only several seconds permits the use of dies constructed from ordinary tool steel. This is in contrast to higher cost superalloy metals that must be used for processes in which higher temperatures and longer pressing time periods at higher temperatures are required. Likewise, because of these low temperatures and because of the relatively short time in the die, the metal particles are not highly oxidized. To keep the metal or metallic particles from oxidizing during the preheating, which may be longer, e.g., ten minutes for alloyed aluminum particles, the preferred heat box having an inert atmosphere therein is used, as above described. It is to be understood that particles may be heated in other and various ways from that disclosed herein. Preferably, the heated metallic alloy particles are heated in the box to a temperature and for a sufficient time for the alloy constituents to go into solid solution for a later precipitation hardening.

The preferred hot pressing operation is accomplished in ambient atmosphere, but if a reduction in the oxidation is desired, particularly for ferrous particles heated to higher temperatures, such as 1800° F., a protective atmosphere may be used about the heated particles when being transferred into and while being hot pressed in the die 14. Usually, a vacuum need not be employed at the die, as this adds to the expense of the process, although some conventional hot pressing techniques use a vacuum. When hot pressing ferrous particles at temperatures of 1800° F. or higher, the heated die 14 should be made of more expensive superalloy materials to provide the requisite strength and longevity for the die at these higher pressing temperatures.

The temperature ranges for hot pressing other particles may be varied but it is preferred to hot press copper or copper alloy particles at about 600°–800° C. The magnesium particles can be hot pressed at about the same temperatures used for aluminum or aluminum alloy particles.

Generally speaking, the process is preferably isothermal with the die 14 and the particles being preheated to the hot pressing temperature. This preheating is necessary because the time of hot pressing is usually so short that the articles could not be heated uniformly throughout in the very short period of the pressing time. Herein, the upper and lower pressing rams were not heated with only the mold walls defining the cavity being preheated. Of course, it is possible to heat the rams as well as the mold walls.

Figure 8:
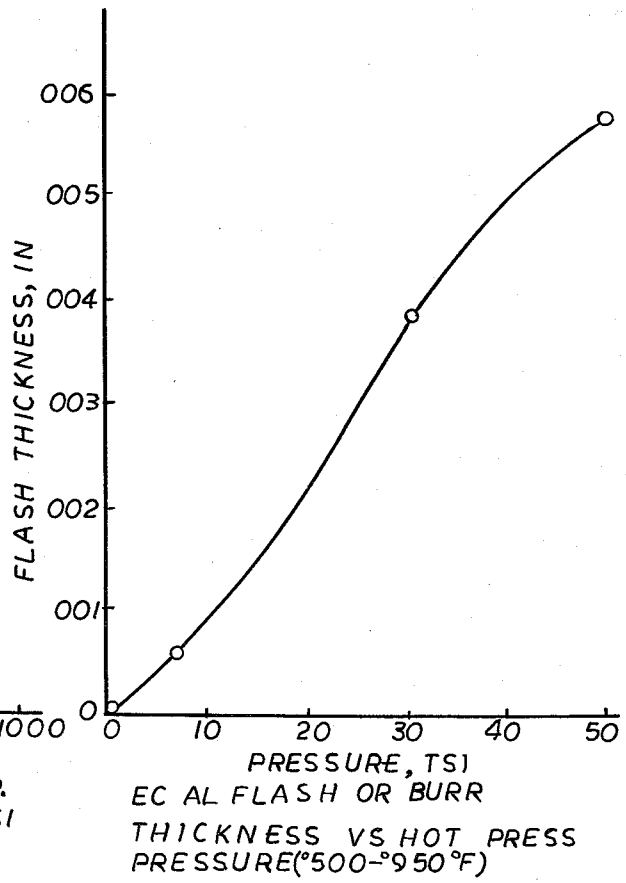
FIG. 8 is a graph illustrating the effect of changes in pressure on flash thickness for articles made in accordance with the invention.
Figure 7:
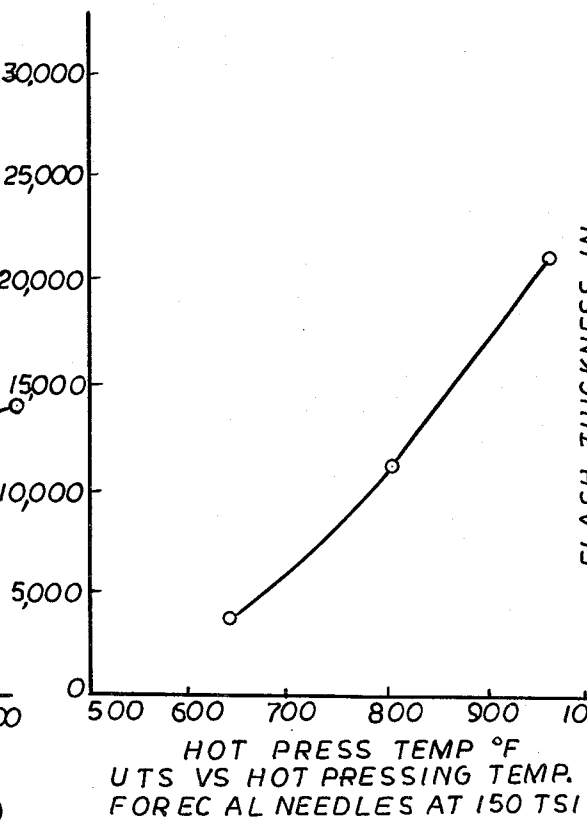
FIG. 7 is a graph illustrating the effect of the change of temperature on the ultimate tensile strength of articles made in accordance with the invention.

The hot pressing pressures may be varied depending upon the particles being used and the density desired for the product. For aluminum alloy particles, pressures in the range of 12,000 psi to 100,000 psi are sufficient to press the aluminum particles into articles having substantially 100 percent full theoretical density. For lower densities, the pressures may be on the lower side. Once full density has been achieved for the article by application of a given pressure, the application of additional higher pressures merely serves to cause the article to tend to bind or weld to the side walls of the die. Also, the higher and excessive pressures force the hot pressed metal further into the die clearance openings and result in greater thicknesses of flash or burrs which will usually be removed. The increase in flash or burr thickness with increases in hot pressing pressure is illustrated in FIG. 8. The pressures used for aluminum of about 12,000 to 50,000 psi at temperatures of 950° F. or less do not readily damage tool steel dies and the die may be used repetitively for the production-like manufacture of particles.

Aluminum and aluminum alloys have an affinity for welding or alloying themselves to the die walls at elevated temperatures and pressures used in hot pressing or powder metallurgy processing. The walls of the die cavity 18 are lubricated with a conventional graphite or lubricant to reduce the likelihood of the article adhering to the die walls. The movement of the particles in the die during hot pressing is considerable as the height of the hot pressed article is about one-half the height of the particles filling the die prior to compaction. A significant movement of the particles along the die wall during hot pressing has been found to wipe the die lubricant from the die wall leaving the die walls generally unprotected during the final pressing portion of the cycle.

In accordance with the present invention, the problem of welding or adhering of the hot pressed particles to the die wall has been overcome by a multi-step hot pressing method in which an initial and major compaction is made in a first portion of the die and a final higher density consolidation is made in another and second portion of the die. The initial compaction of the particles reduces the fill volume in the die to about the final size for the article with the particles undergoing more gross movements and hence to scraping some of the die lubricant from the die walls. The welding of the article to the non-lubricated areas of the die walls is avoided by shifting the initially and partially consolidated article in the die to a portion which was not filled with particles and hence not scraped of the die lubricant thereon. Then the final and usually higher pressure is applied in this second portion of the die. The final pressure consolidates the article to its full and final density usually at or close to theoretical density and the final pressure is usually significantly higher. By way of example only, scrap metal aluminum particles were compacted at 950° F. by very low pressure of 4,000 psi to about 85 percent of theoretical density and then shifted upwardly into the die cavity where lubricant was still present. At this time, the upper die further compacted the particles to 99 percent plus of theoretical density with the particles undergoing relatively small movement along the die walls during this final 15 percent compaction which takes up most of the internal voids and may be made at about 24,000 psi. The entire process may still be made in under ten seconds with the initial pressure taking only one second or two and the final pressure application likewise taking only one or two seconds. The difference between the one and two-step process of hot pressing is noticeable in that articles made with a one-step process tend to be scored on the outer surface thereof when contrasted with articles made with the two-step process.

Typical lubricants are graphite or boron nitride. The residue of the lubricant on the outer surface of the articles made by the two-step process may even be advantageous with the lubricant again being used during a subsequent forging in a forging press.

By way of example, the following examples will be given for illustrative purposes:

EXAMPLE 1

EC aluminum scrap containing 2 to 3% copper as an impurity was converted into needle-like particles by melting the scrap and pouring it into a spinning cup of 3" diameter having holes of 0.052" diameter. "EC" aluminum refers to aluminum typically found in electrical cables as a current-carrying conductor. The molten metal was at 1300° F. and the cup was spun at 1500 rpm. The needles were cooled and collected. The needles had a good luster. A charge of needles about 0.5 inch in depth was inserted into a split die formed of tool steel containing a tool body having a cavity opening measuring 1-$\frac{7}{8}$ inch by $\frac{3}{8}$ inch. The die was placed in a stainless steel closed chamber evacuated to 28" of mercury and heated to 950° F. At this temperature, the ram was actuated to apply 30,000 psi pressure to the needles for about two seconds. The die was then taken from the chamber and split open and the resulting compacted article having a thickness of about 0.25 inch was readily removed. The article quickly air cooled at ambient room temperatures to a temperature below the recrystallization temperature. The needles were found to be thoroughly compacted, welded and intermeshed into a unitary article having a density equal to almost 100% of theoretical density. The Rockwell hardness value varied from R/H 82 to 85 across the various sides of the article. A tensile specimen from the article had an ultimate tensile strength of 21,875 psi and a yield tensile strength of 19,320 psi. The elongation appeared to be about 4.2%. The structure was clean with a precise smooth exterior with virtually no holes therein. When cut in cross section, some elongation of the needles was observed and many fine grains were seen within the individual needles. There was no significant grain growth observed.

EXAMPLE 2

Needles produced as above described in connection with Example 1 were loaded as an 8 gram charge into the lubricated, split, tool steel die having the same size of cavity. Using the same conditions above except that pressure which was increased to 100,000 pounds per square inch, the article was found to have the same exterior and observable properties as above described and tested out to an ultimate yield tensile strength of 21,555 psi; a yield tensile strength of 19,205 psi; elongation of 4.4% and a Rockwell hardness of R/H 81 to 83 about the article. There was no observable grain growth as the article had been allowed to cool quickly below its recyrstallization temperature after removal from the die.

EXAMPLE 3

Clean aluminum 7075 machine shop drillings were broken up and loaded into the 1-$\frac{7}{8}$ inch by $\frac{3}{8}$ inch die cavity. An 8 gram charge was heated to 900° F. and the preheated swarf particles were hot pressed at a pressure of 100,000 psi for a period of less than 5 seconds. The ejected article was allowed to air cool immediately to a temperature less than its recrystallization temperature. The compact article was well bonded and had about a 99.1% of theoretical density and an R/H hardness of 94.9. The compact was cleaned by a vibratory cleaner and then ball burnished to a mirror-like finish.

EXAMPLE 4

Needles of the type set forth in Example 1 were made into 250–300 gram charges and placed into a cylindrical die cavity of about two inches in diameter and about two inches in length. The die and the particles were heated to a temperature of 950° F. and then the needles were initially compacted at a pressure of 4,000 pounds per square inch for about one second to consolidate into a compact particle having a first predetermined low density, for example, about 85% of theoretical density. The low density cylindrical slug was uniform and almost "loose" in the die with this initially applied pressure principally collapsing the plastic needles with a gross movement of needles occurring within the die. During this initial hot pressing, no great lubricant removal from the die walls was seen and no galling appeared to have taken place. This initially hot press slug was removed from the die, the same die relubricated and the low density slug was re-hot-pressed at 950° F. at 48,000 psi for 5 seconds. The article was then allowed to air cool quickly below its recrystallization temperature. The final hot pressed article had become significantly more dense as its density shifted from about 85% to about 100% of full theoretical density. Some of the aluminum extruded into the die clearance during the second pressure application.

However, no die galling or slug scoring was evident after the second hot pressing operation. The article finally produced was generally uniform in appearance and its Rockwell hardness R/H was varied by only two points along the sides thereof. Similar size slugs of 2" in diameter and up to 2" in length have been produced with the initial pressing at 950° F. and to 85% theoretical density at 4,000 psi. These slugs were removed from the die and then re-hot-pressed in the same die (now relubricated) with a pressure of 24,000 psi for a period of 5 seconds to produce articles having full density. These articles were also air cooled to below their recrystallization temperature.

In addition to the above-described examples, further rectangular bars measuring 1.875"×0.375"×0.25" dimensions were produced generally in accordance with the procedure set forth in Example 1 and examined to determine the effect of variations of temperature and pressure on the formation of the hot pressed article. Photomicrographs of such further examples produced generally in accordance with Example 1 are shown in FIGS. 11–14. As explained, temperature is the main variable and additional pressure beyond that needed to compact the article to 99% or greater of theoretical density is relatively unimportant. Generally, the time period was not varied significantly beyond five seconds with most of the articles being formed in only the time it takes to assure actual application of the pressure indicated, e.g., 15 tsi; 30 tsi; or 50 tsi. In actual production of parts on a commercial scale, the time of application need only be that to apply pressure to consolidate the particles and fill all of the die crevices. It has been found that the particle material flows better at higher temperatures, for example, 900° F., than at lower temperatures, for example 650° F. The plastic flow characteristic is important in order that the particle material fill the spline, crevices, or narrow cavities as well as to eliminate any internal voids within the article so that the article is dense and relatively leak proof when contrasted with the usual powder metallurgy articles. Another outcome of poor plastic flow is failure to provide a uniform thickness throughout the article when hot pressing the flat rectangular bar specimens. It was found that when forming these bars at 650° F. that the thickness variation was as much as 0.008 inch, as illustrated in the graph shown in FIG. 2. By increasing the hot pressing temperature, the plasticity of the heated particles increased and the thickness variation was dropped substantially and to almost zero at 925° F. at a pressure of 30 tsi.

To provide a better understanding of how the factors of temperature and pressure affected the relative surface finish, the above described rectangularly shaped articles were made at temperatures of 650° F., 800° F. and 950° F., and also at three different pressures, namely, 15 tsi, 30 tsi and 50 tsi. A purely arbitrary scale of 1 to 10 was chosen with a 10 score being given to surfaces which were smooth, flat and generally solid appearing and with the particle outlines being discernible only with difficulty. At the other end of the scale, a score of 4 or less indicated that the surface of the rectangular bar was irregular and not smooth and flat with the particle outlines clearly shown. With such poor surface conditions, the particles appear loosely joined rather than fully intermeshed and integrated with one another. Generally speaking, at the lower temperature of 650° F., and particularly at the lower pressures, for example, 15 tsi, the surface finish ratings were low, e.g., 4 and 6, as best seen in the graph of FIG. 3. At these lower temperatures and pressures, the articles appeared somewhat porous with the needles clearly outlined and not fully meshed together as they are at the higher temperature and pressure. At the higher temperatures and pressures of 950° F. and 30 tsi plus, the surface finish ratings were 8 to 10; and the articles appeared to be fully dense and have zero porosity and have their needles so well integrated that only with some difficulty is it possible to see the outline of the needles, particularly after the articles have been cleaned.

If the pressure used is sufficiently high, such as 30 tsi to 50 tsi, then the surface finish is found to be good, e.g., 8 or greater, even though the temperature is varied from about 650° F. to 950° F., as depicted in FIG. 3. The pressing temperature becomes significant at lower pressures, e.g., 15 tsi, for the reason that the particles will not experience the desired plastic flow at temperatures of less than about 700° F. to afford a surface finish of 8 or greater, as depicted in FIG. 3. Likewise, if a pressing temperature of 650° F. is used, good plastic flow is not achieved until a pressure of about 30 tsi is used, as shown in FIG. 4. Sufficient plastic flow to provide a good surface finish, i.e., 8 or more, was obtained at temperatures 650° F. to 950° F. at the higher pressures of 30 tsi and 50 tsi with the best surface finishes being obtained for the higher pressure of 50 tsi, as depicted in FIG. 3. Thus, it appears that higher pressures and temperatures provide more plastic flow and more dense articles with the best surface finishes, and this is depicted in FIGS. 3 and 4. At the lowest pressures and temperatures illustrated in FIGS. 3 and 4, the articles appear porous with the particles clearly outlined and not fully meshed together.

The Rockwell hardness may be substantially uniform when the article has been pressed to be substantially fully dense. As will be explained in connection with FIGS. 5 and 6, the differential of about two to four points for a fully dense, hot pressed article is achieved and this is acceptable commercially. Thus, the graph in FIG. 5 shows that a Rockwell hardness spread of less than four is obtainable when hot pressing at 950° F. with pressures of 15, 30 and 50 tsi. Likewise, for articles hot pressed at 800° F., the Rockwell hardness spread is below five for each of the pressing pressures of 15, 30 and 50 tsi. On the other hand, when the article is not fully dense as when compressed at 10 tsi and at 650° F., the hardness of the article varies substantially from one area to another area, as indicated by the differential of 24 between different Rockwell hardness readings in FIG. 5. However, at the higher pressure of 50 tsi and a 650° F. pressing temperature, the article may be compacted to be fully dense and provide an acceptably uniformly hard product.

Figure 6:
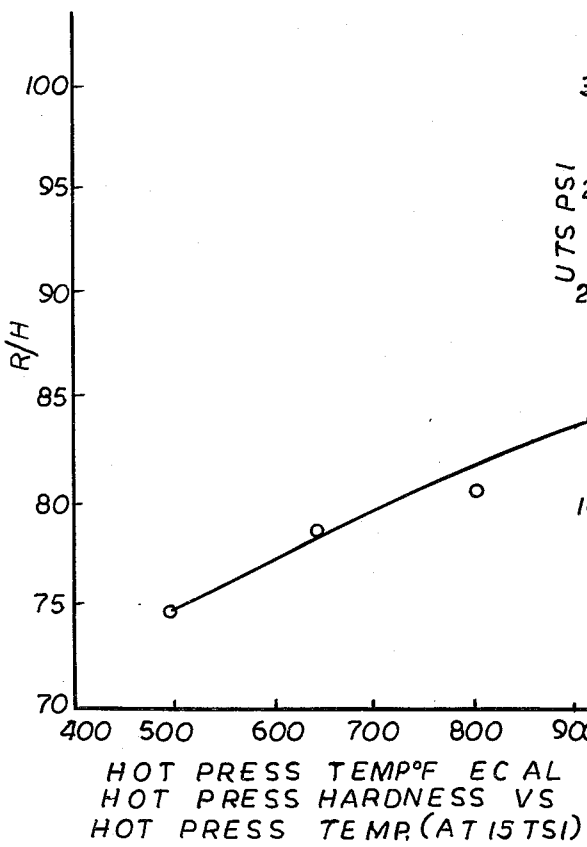
FIG. 6 is a graph illustrating the effect of a change in temperature on the Rockwell Hardness for the articles made in accordance with the invention.

It has been found that as density of the article increases, the Rockwell surface hardness of the article also increases. As shown in the graph of FIG. 6, when hot pressing at constant pressure of 15 psi and with an increase in temperature of pressing from about 500° F. to 950° F., the density of the product increased and the Rockwell R/H increased from about 75 to 85 R/H.

The temperature used during the hot pressing has a significant effect on the tensile strength of the article with the higher tensile strengths being obtained for the higher temperature hot pressing operations when using the constant pressure. This is because the product will be more dense with higher temperature pressings if a low and constant pressing pressure, e.g., 15 tsi, is used. When about 100% density is achieved, the articles had ultimate tensile strengths of 22,700 psi for scrap EC aluminum (with 2 to 3% copper as an impurity pickup) needle hot pressed article, as indicated for a 950° F. pressing temperature in FIG. 7. These articles having the 22,700 psi UTS had a 6.4% elongation and appeared to have microstructures of fully annealed parts although they had not been held at elevated temperatures for a time period sufficiently long enough for an annealing operation to have occurred. The above-described graphs were made from data using these EC aluminum articles.

Figure 10:
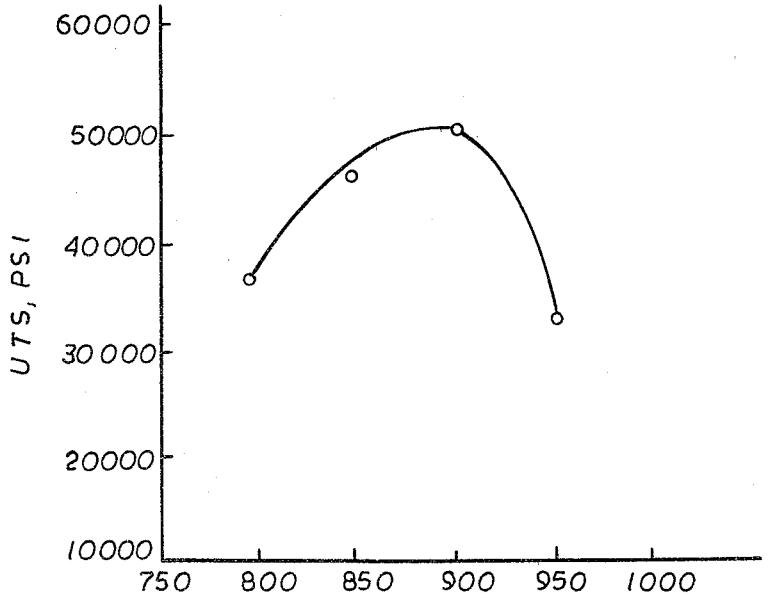
FIG. 10 is a graph illustrating the effect on ultimate tensile strength of hot pressing at temperatures below and above the solidus temperature.

Testing of articles made by hot pressing of 7075 aluminum swarf articles likewise showed increased tensile strengths obtainable with increased temperature until a temperature exceeded "about the solidus temperature". More specifically, the ultimate tensile strength increases significantly with an increase in temperature from about 750° to 900° F. at 50 tsi. Above 900° F. for this alloy, melting of the particles began and this resulted in a remarkable and significant decline in tensile strength as shown in FIG. 10. Specifically, 7075-0 aluminum scrap chips hot-pressed at 900° F. and 50 tsi for five seconds had an ultimate tensile strength of 52,000 psi. However, the ultimate tensile strength dropped to less than 35,000 when these particles were heated to 950° F. and hot-pressed at 50 tsi. The 52,000 psi tensile strength is about 160 percent greater than that of bar stock of 7075-0 aluminum. Looking differently at the ultimate tensile strength of 52,000 psi, this is about two-thirds that which could be obtained for this alloy after a T-6 full heat treatment which involves a solution heat treating at 850° F. and aging at 250° F. for 25 hours.

Figure 9:
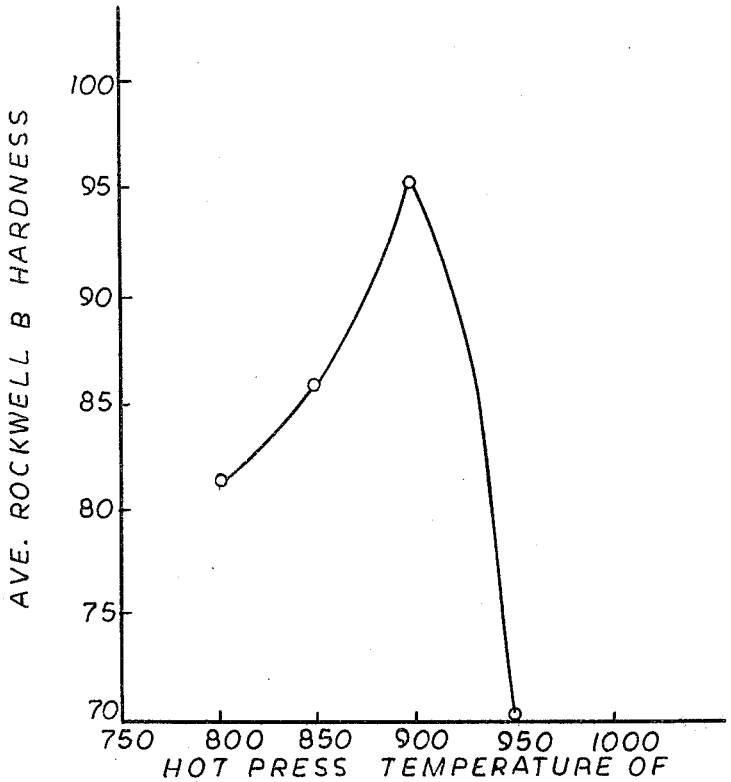
FIG. 9 is a graph illustrating the effect on Rockwell Hardness of articles hot pressed at temperatures below and substantially above the solidus temperature.

When the particles are heated and compressed at temperatures above about the solidus temperature at which some of the particles melt, the hardness average drops rapidly and significantly. Thus, swarf of 7075 aluminum when hot pressed at 50 tsi for two seconds at temperatures between 900° F. to 950° F. experiences a rapid drop-off into a range of 95 to 70 average Rockwell E hardness, as illustrated in FIG. 9. On the other hand, the Rockwell hardness average increased substantially with temperature increases from 800° F. to 900° F. as the articles became more dense and hard at the higher temperatures up to about the solidus temperature.

Figure 13:
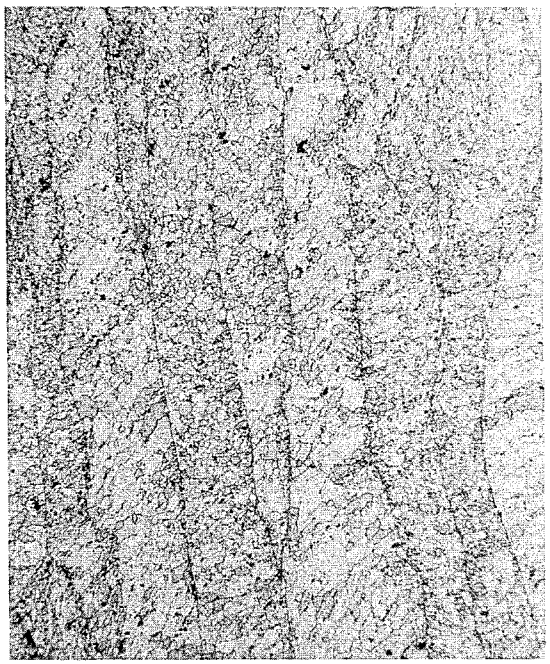
FIGS. 11, 12, 13 and 14 are magnified photomicrographs of etched sections of hot pressed articles formed by hot pressing particulates in accordance with the invention.

A photomicrograph of an article formed by hot pressing 7075 aluminum swarf pressed at 900° F. at 50 tsi for five seconds is shown in FIG. 13. The photomicrograph of FIG. 13 is made of a longitudinal cross section etched at 100×. A lamellar construction is visible in FIG. 13 showing the outlines of the swarf particles within which outlines are fine equiaxed grains. Unlike the structures disclosed in U.S. Pat. No. 3,076,706, there is no fibrous character shown in FIG. 13 or 14 for a metal section. A transverse cross section (not shown) discloses no particular directionality which points up the isotropic property found for these articles.

Figure 12:
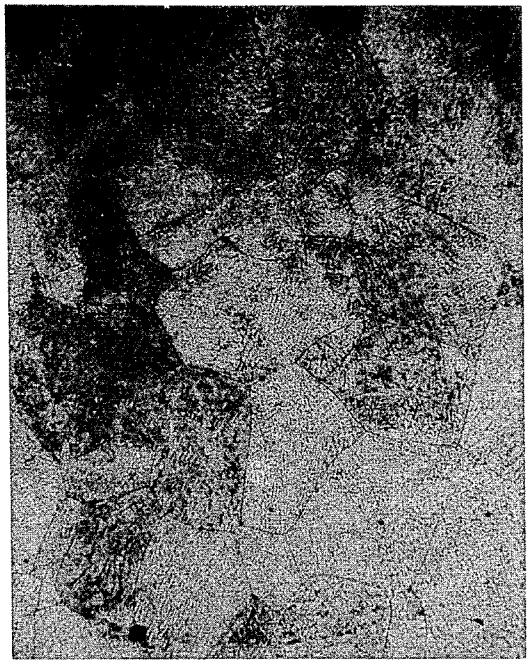
Figure 11:
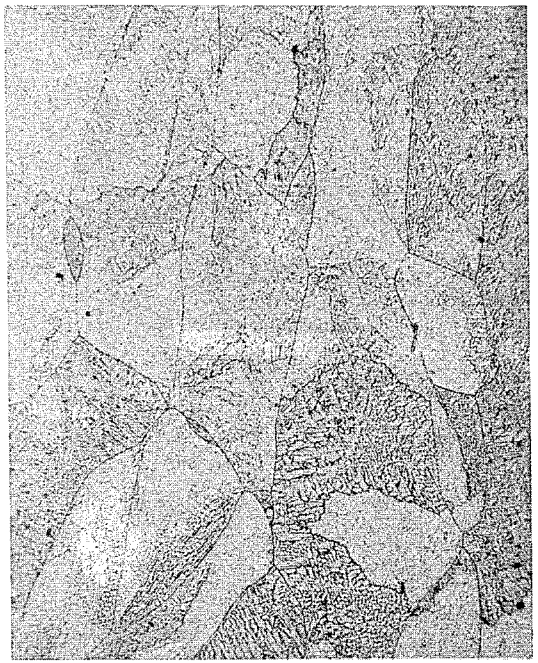

The particle outlines are also visible in the 50× photomicrograph (FIGS. 11 and 12) of sections taken of articles formed of EC aluminum needle-like particles hot pressed at 950° F. and 15 tsi for five seconds in accordance with the method of the invention. FIG. 11 is a longitudinal section showing sound structure with particles fully intermeshed without holes and FIG. 12 is a transverse section likewise showing visible outlines is shown in the 200× etched photomicrograph of FIG. 14 which is a section of an article formed of hot pressed EC aluminum needle-like particles.

It should be noted that for each of the illustrated photomicrographs the structures are sound with virtually no holes therein. The matrices appear to be clean. This is in contrast to powder metallurgy compacts which are porous and generally show some holes therein.

Sound nonporous articles may be used in pressurized fluid applications whereas porous and leaking articles cannot be used. For instance, dense, hot pressed articles may be used in hydraulic lines or pneumatic lines which must be relatively leak-proof to the pressurized fluids carried therein. Generally speaking, articles made of aluminum by a sintered powder metallurgy process or by a die casting process have leaked and have not been used in such applications. By way of example only, hot pressed aluminum test samples having only about a ⅛ inch wall thickness were tested and found to be leak-proof to pressurized hydraulic oil at 2500 psi therein and also to pressurized helium gas at 400 psi therein. Such a leak-proof characteristic along with improved strength characteristics make such hot pressed articles (with or without a subsequent forging into shape) usable in applications heretofore not possible with conventional die cast or powder metallurgy parts of aluminum.

Most of the work has been done with aluminum or aluminum alloy particles. However, such tests have been run to indicate that other metals can also be hot pressed in accordance with the invention and these metals include, but are not limited to, magnesium, copper and iron. Further examples will be given for illustrative purposes.

EXAMPLE 5

The substantially pure magnesium was chopped into 1/16" to ⅛" long pieces with the pieces having a surface area to volume relationship of about 360. The split mold used and described above was used with a charge of about 3.105 grams with magnesium. The particles were preheated to about 900° F. and the particles were pressed between the top and bottom rings while placed in a stainless steel closed chamber evacuated to 28" of mercury vacuum. Bars were pressed in the preheated die at about 900° F. and 24 tsi pressure for two seconds. The die was then taken from the chamber and split open with the compacted article removed and allowed to air cool to ambient room temperature which is below the recrystallization temperature. The surface finish was good. An elongation of 5.2% in ¼ inch was obtained. The compacted density of about 97.6 and a Rockwell Hardness on the H scale of 28. A test bar measuring about 1.8 in length by 0.37" in width by 0.15" thickness was pulled and provided an ultimate tensile strength of about 27,200 psi. The structure appeared clean and with virtually no holes therein.

Figure 15:
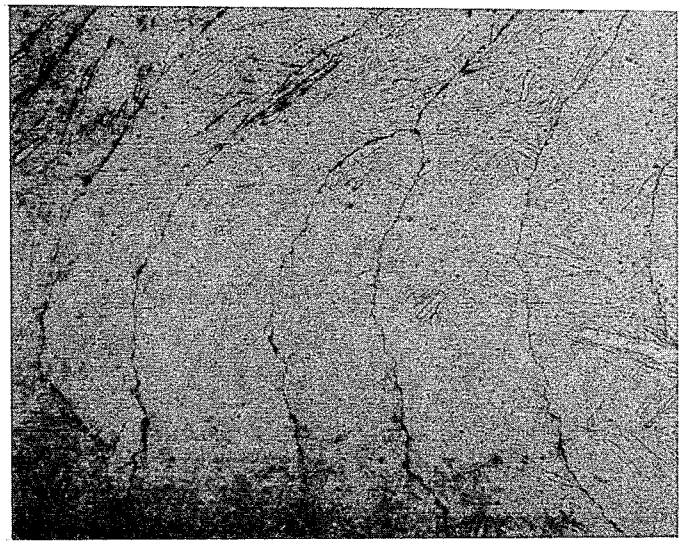
FIG. 15 is a magnified photomicrograph of an etched section of a hot pressed article formed by hot pressing magnesium particulates as described in Example 5 hereinafter.
Figure 14:
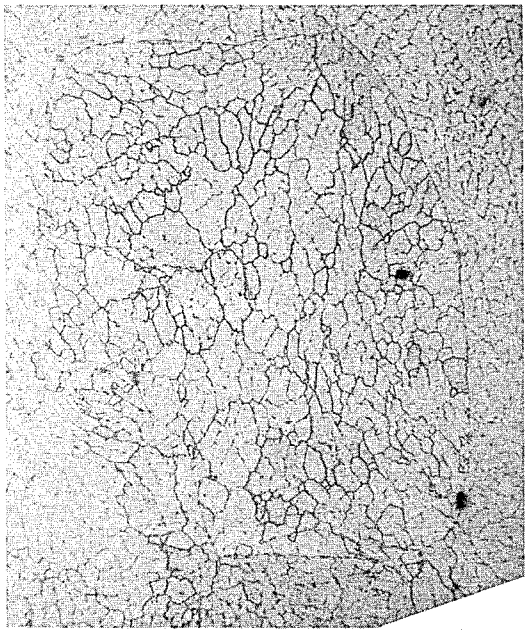

When using the same magnesium material and changing only the pressure to 12 tsi, the ultimate tensile strength was found to be considerably less, namely, 8,960 psi, the hardness 65, and the density 98.9% for a hot pressed magnesium article. FIG. 15 is a photomicrograph of a section etched at 100× of the magnesium article pressed at 12 tsi.

EXAMPLE 6

A magnesium wire which appears to be of duplex alloy consisting predominantly of magnesium was also hot pressed to form test bars which measured about 1.8" in length by 0.37" in width by 0.16" thickness. The bars were also pressed at 900° F. under 24 tsi pressure for two seconds. The wire particles had a surface area to volume relationship of about 50. The particles were preheated to 900° F. as was the split die. The resulting test bar had a weight of about 3.1 grams and a volume of 1.8 cc. The bar had a smooth exterior surface. An elongation of 3.2% in ¼ inch was obtained. The bar had a density of about 102.1% and a Rockwell B Hardness of about 34. This density value of over 100% was caused by the inclusion of oxide in the article being weighed. The tensile specimen from the article had an ultimate tensile strength of about 12,100 psi.

Figure 16:
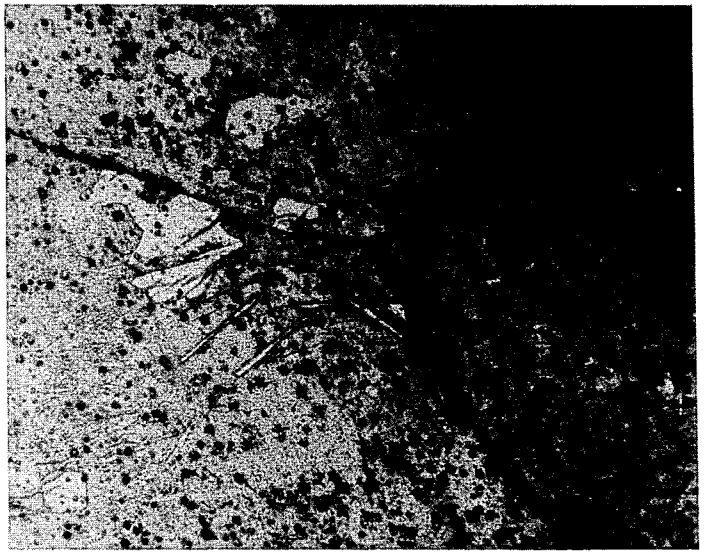
FIG. 16 is a magnified photomicrograph of an etched section of a hot pressed article formed by hot pressing magnesium particulates as described in Example 6 hereinafter.

When using the same magnesium wire and hot pressing at 900° F. for 2 seconds but at a lower pressure of 12 tsi, the magnesium hot pressed articles had a density of 98.2%, a hardness of 41, and an ultimate tensile strength of 3,400 psi. The structure was generally clean with no holes therein being observable, as can be seen in FIG. 16, which is a photomicrograph from this magnesium hot pressed article.

Magnesium particles having a SA/V relationship of about 180 were also hot pressed as described above in connection with Examples 5 and 6 and the articles formed had a good surface finish 8 and Rockwell hardness of about 67. The ultimate tensile strength was about 12,970 psi. The article had an elongation of 2.8% in ¼ inch. When the same magnesium particles having a SA/V relationship of about 180 were pressed at 900° F. for 2 seconds but at 12 tsi, the ultimate tensile strength was found to be only about 1,280 versus the 12,970 psi for the article pressed at 24 tsi apparently due to the less complete welding of the particles when hot pressed at the pressure.

In other examples, magnesium powders having SA/V relationships of about 3500 were hot pressed at 900° F. and 12 tons per square inch pressure. These latter articles made from magnesium powder were too soft having Rockwell hardness ratings of −3 on the H scale. There was a considerable difference in U.T.S. ranging between 1280 and 9860 psi and it appears that the presence of large amounts of surface oxide and other impurities caused this problem. At 24 tsi, the articles made from powder had a hardness of 95, a density of 105.2, an ultimate tensile strength of 18,630 psi and an elongation of 2.0% in ¼ inch.

Generally speaking, it appears that better results can be obtained by hot pressing particulates at higher pressures, e.g., 24 tons per square inch, and with particulates which are more oxide free than the powders used and described above. When increasing the pressure from 12 tsi to 24 tsi, the ultimate tensile strengths generally increased from by 90% to over 900%, while the hardness and density values did not change appreciably.

Turning to the hot pressing of copper, in accordance with the invention, a further example is as follows:

EXAMPLE 7

Figure 17:
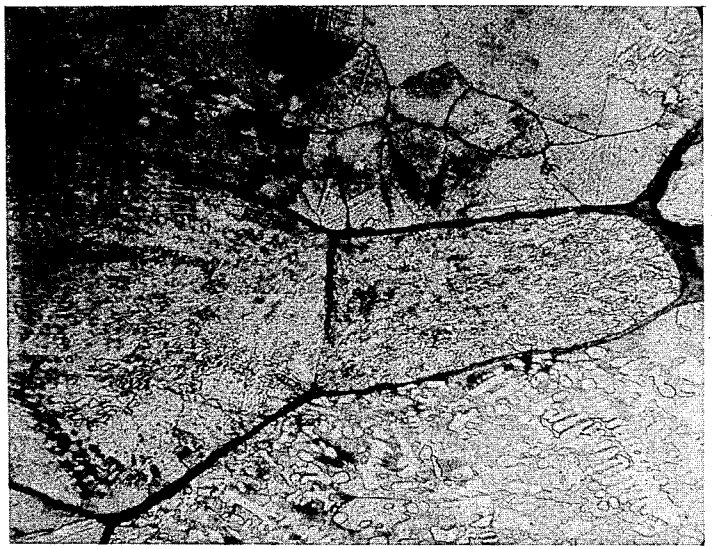
FIG. 17 is a magnified photomicrograph of an etched section of a hot pressed article formed by hot pressing particulates of copper as described in Example 7 hereinafter.

Generally spherical pieces of copper shot of substantially pure copper metal having an SA/V relationship of about 100 were preheated to about 950° F. and the split mold die was likewise heated to 950° F. A charge of particles weighing 24.03 grams was inserted into the die and pressed at about 50 tsi for a period of about one second at 950° F. Articles had a surface finish rating of about 7 and these articles had densities of about 96.2%. The hardness on the Rockwell B scale was 23. Test bars have dimensions of about 1.863" in length by 0.381" in width by 0.240" in thickness having a volume of about 2.792 cc were pulled. It appears that the copper shot particles had too much oxide and that better results would have been obtained with cleaner copper particles. The oxide appears to make the articles more brittle. Also, it appears desirable to hot press the copper particles at higher temperatures than the 950° F. used herein. Furthermore, powders of copper were pressed and were found to give good clean looking structures with densities in the range of about 95.7 to 98.7% and Rockwell B hardnesses of 12 to 51. No tensile test data is available for the hot pressed copper articles. A cross section is shown in FIG. 17.

It has been found iron powder may also be hot pressed in accordance with the method of the invention. More specifically, preheated carbonyl powders having an SA/V relationship of 50,800 were hot pressed after being preheated to 950° F. at 50 tsi for about one second in a die preheated to 950° F. The density obtained was about 95.5 of theoretical full density and the article had a Rockwell hardness on the RC scale of about 48. A tensile specimen weighing about 24,483 grams and having a length of 1.867 inch, a width of 0.380 inch; and a thickness of 0.280 inch was pulled. It appears some excess carbon was picked up in the process making the test specimens extremely brittle. The article fractured repeatedly in the test grips of the tensile testing machine; with the gauge length region withstanding pulls of 35,690 psi.

A coarser powder of carbonyl having a SA/V relationship of 15,200 was also preheated to 950° F. and was hot pressed in a die heated to 950° F. under 50 tsi for one second. The articles formed had a density of about 98.6 of theoretical density and a hardness of about 13 on the Rockwell C scale. Tensile test bars of about the same size as described above were pulled to a U.T.S. of 96,240 psi which is high for an essentially pure iron article.

The results seem to indicate that particles of iron other than carbonyl iron at higher temperatures of about 1800° F. to 2000° F. would give satisfactory results.

From the work performed, other metal particles such as nickel at 1800° F to 2000° F. appear to be capable of being hot pressed to form a wrought nickel article with an isothermal heating of the particles and dies. Also, molybdenum and tungsten particles preheated to about 3000° F. should be capable of being hot pressed at dies heated to about 3000° F. The pressures used should be in excess of 12,000 tsi and better results should be obtained with higher pressures of about 50,000 tsi. To withstand such temperatures and pressures, the die materials will have to be built of refractory materials. The time of high pressure application should be less than several seconds in contrast to the long time sintering processes of the prior art in which the pressure was applied for at least several minutes and as much as one-half hour. As used herein, the term "hot pressing" refers to a simultaneous application of heat and pressure over a short period of time as distinguished from a longer term sintering process. Likewise, the hot pressing process should be distinguished from a rolling process for rolling particles in which the particles are extruded or stretched as they go into and through the nip of the rollers and form a fibrous structure for the metal as described in the aforementioned patent.

The hot pressing method disclosed above may be further implemented by adding other materials to either the particles themselves or to the die cavity. For instance, the cost of metal may be lowered by the addition of lower cost filler material to the metal prior to formation of the metallic particles. Preferably, such fillers would have a density close to that of the molten metal into which the fillers are added so as to provide a more homogeneous character to the filled metal particles which are to be later hot pressed. Additional strength can be obtained by adding strengthening materials into the die for incorporation into the article. For example, carbon fibers could be added into the mold in layers or groups for being interlocked into the metallic article thereby providing additional strength to the article. Herein, the carbon fibers would remain elongated to give their maximum strength to the article. It is thought carbon fibers of about 10% to 40% of the volume could be added into the mold and hot pressed suitably.

The preferred larger size particles usually provide better results than do smaller size powders as evidenced by the higher tensile strengths as hardness obtained when increasing the aluminum particulate size from SA/V of 1500 down to about 3. The SA/V relationships disclosed herein are all derived by measuring the nominal diameter in inches, for generally rounded particles, and then calculating the surface area and volume. The numbers for the SA/V relationship all have a unit of $10^{-1}$ inch which has not been included herein. Of course, if the measurements are made in the metric system then the numbers defining the particle size range will change and the unit will be $10^{-1}$ centimeters. Generally, it will be possible to use powders in the process so long as the powder particulates do not sinter weld when preheated, this being particularly a problem when trying to use extremely fine aluminum powders; and, so long as one can accept a lesser strength, hardness and/or other property. In some instances, a lesser strength or less hard article is adequate and powders may be used in the process of the present invention and fall within the ambit of some of the claims of the present invention.

From the foregoing it will be seen that a new process has been found for the production of wrought metal articles having good strength, close dimensional tolerances, and good surface characteristics. The process is economically attractive in that scrap metals may be used and in that alloy metals, such as aluminum alloys, may be used as well as pure metals for the particles. Further, additives may be added to the metal particles, such as carbon fiber additives, to increase the strength of the article or, in the case of filler additives, to decrease the cost of the metal in the article. The process lends itself to high production from a press and the articles, such as preforms, may be immediately transferred from the hot press for further treating, such as a heat treating or a forging thereof in a forging press, while still hot. On the other hand, the hot articles may be allowed to air cool or be quenched to return quickly below their recrystallization temperature to prevent substantial grain growththat would decrease their hardness and tensile strengths.

While a preferred embodiment has been shown and described, it will be understood that there is no intent to limit the invention by such disclosure, but, rather, it is intended to cover all modifications and alternate constructions falling within the spirit and scope of the invention as defined in the appended claims.

What is claimed is:

1. A method for the manufacture of hot pressed articles from metallic or metallic alloy particles, said method comprising the steps of:

providing particles having a dimension in one direction of at least 1,000 microns and having a surface area to volume relationship in the range of between about 3 and about 1,000 and providing sufficient metal volume for strain hardening when being hot pressed, preheating the particles to a predetermined temperature in the range from the recrystallization temperature to the incipient melting temperature for the metal or alloy and which is a sufficiently high temperature to provide high plasticity for the particles being worked and strain hardened during hot pressing, heating a die cavity to a temperature sufficient to maintain the particles at said predetermined temperature during subsequent hot pressing, introducing the heated particles into the heated die cavity, hot pressing the preheated particles in the die for a time period of less than 30 seconds while the particles are heated to said predetermined temperature at a pressure in excess of 12 tsi to work the highly plastic particles sufficiently to strain harden the particles and to consolidate the particles into a high density article, and removing the article from said heated die cavity.

2. A method in accordance with claim 1 including the further steps of hot pressing the preheated particles within said temperature range with sufficient pressure to form an article having a density of at least 99% of theoretical density for the article and cooling the article to a temperature below the recrystallization temperature before substantial recrystallization and grain growth occurs.

3. A method in accordance with claim 2 in which the hot pressing of the particles comprises an initial low pressure pressing during which the particles are compressed to substantially the final volume for said article followed by higher pressure pressing to the desired density.

4. A method in accordance with claim 1 in which the metallic particles are aluminum or aluminum alloy particles having at least one cross-sectional dimension exceeding 1,000 microns.

5. A method in accordance with claim 4 in which said particles and said die are each preheated to a temperature in the range of between about 400° C. and about 600° C.

6. A process in accordance with claim 5 in which the pressure applied to compress the heated particles to their final density is within the range of between about 24,000 and about 100,000 psi.

7. A method in accordance with claim 1 in which the hot pressing of the particles is effected within a time of less than about 5 seconds.

8. A method in accordance with claim 1 including hot pressing the particles in ambient atmosphere without a protective atmosphere thereabout.

9. A method in accordance with claim 1 in which said article is removed from said die cavity at a sufficiently high temperature that said article may be quenched and including the further step of quickly quenching the article after removal from said die.

10. A method in accordance with claim 1 in which said hot pressing step consolidates said particles to substantially full theoretical density and with substantially no gas porosity.

11. A method in accordance with claim 10 including the step of hot pressing the particles at about the solution annealing temperature for the metal or alloy and subsequently age hardening heat treating said article.

12. A method for the manufacture of closely dimensioned articles from metallic or metallic alloy particulates, said method comprising the steps of:

lubricating the walls of a die cavity, heating the particulates to a temperature within the range of between about the recrystallization temperature for the metal or alloy and the solidus temperature for the metal or alloy, hot pressing the heated particulates in a first heated and lubricated portion of said die cavity at a first pressure to substantially compress the particulates into an article, shifting the article to another heated portion of said die cavity, and pressing the article at a second pressure greater than said first pressure in said another portion of said die cavity.

13. A method in accordance with claim 12 wherein said particulates are aluminum or aluminum alloy particles having a minimum dimension in one direction of at least 1,000 microns and after the pressing step performing the further step of cooling said article to below said recrystallization temperature before recrystallization and grain growth occurs.

14. A method in accordance with claim 13 in which said particles and said die are each preheated to a temperature in the range of about between about 400° C. and about 600° C.

15. A method for the manufacture of articles having a cross-sectional thickness of one-half inch or more from metallic or metallic alloy particulates, said method comprising the steps of:

lubricating the walls of a die cavity, heating the particulates to a temperature within the range of between about the recrystallization temperature for the metal or alloy and the solidus temperature for the metal or alloy, pressing the particulates in said first lubricated and heated portion of said die at a first pressure to substantially compress the particles into an article, shifting the article to another and lubricated and heated portion of said die and pressing the article at a second pressure greater than said first pressure to further densify the article, and subsequently removing the densified article from said die.

16. A method in accordance with claim 15 in which said particulates are aluminum or aluminum alloy particles.

17. A method in accordance with claim 1 in which the steps of preheating the particles and hot pressing the particles comprises the step of heating the particles to a temperature substantially above an annealing temperature for said metal and hot pressing the particles while at a temperature substantially above the annealing temperature.

18. A method in accordance with claim 1 in which the step of hot pressing the particles includes the step of heating the particles to a temperature close to about said solidus temperature for the metal alloy.

19. A method in accordance with claim 9 including the further step of allowing the article to age or quench harden and superimposing additional strength or hardness onto the already strain hard article.

20. A method in accordance with claim 1 in which said particles are metal alloys and including the further step of quenching the article to cause the article to have a superimposition of age or quench hardening on the already strain hardened article.

21. A method for the manufacture of hot pressed articles from aluminum alloy particles, said method comprising the steps of:

providing aluminum alloy particles having a dimension in one direction of at least 1,000 microns and having a surface area to volume relationship in the range of between about 3 and about 1,000, preheating the particles to a predetermined temperature which is substantially above the recrystallization temperature for aluminum alloy and close to about the solidus temperature to render the particles highly plastic for being worked and strain hardened during hot pressing, heating a die cavity to a temperature sufficient to maintain the particles at said predetermined temperature close to said solidus temperature during subsequent hot pressing, introducing the heated particles into the heated die cavity, hot pressing the preheated particles in the die for a time periof of less than 30 seconds while the particles are heated to said predetermined temperature at a pressure of at least 12 tsi to work the highly plastic particles sufficiently to strain harden the particles and to consolidate the particles into a high density article, and removing the article from said heated die cavity.

22. A method in accordance with claim 27 including the further step of quenching the article and aging the article to superimpose additional strength on the strength achieved by strain hardening.

* * * * *

UNITED STATES PATENT AND TRADEMARK OFFICE

CERTIFICATE OF CORRECTION

PATENT NO. : 4,244,738

DATED : January 13, 1981

INVENTOR(S) : Samuel Storchheim

It is certified that error appears in the above—identified patent and that said Letters Patent is hereby corrected as shown below:

Column 4 Line 56, "then" should be --than--.

Column 5 Line 43, "100" should be --1000--.

Column 20 Line 15, "growththat" should be --growth that--.

Column 22 Line 61 (Claim 22), "27" should be --21--.

Signed and Sealed this

*Sixth* Day of *October 1981*

[SEAL]

*Attest:*

GERALD J. MOSSINGHOFF

*Attesting Officer*

*Commissioner of Patents and Trademarks*